US007850026B2

(12) United States Patent
McKay

(10) Patent No.: US 7,850,026 B2
(45) Date of Patent: Dec. 14, 2010

(54) CRANE ASSEMBLY

(76) Inventor: Douglas McGregor McKay, 68 Station Street, Norlane, Victoria (AU) 3214

( * ) Notice: Subject to any disclaimer, the term of this patent is extended or adjusted under 35 U.S.C. 154(b) by 516 days.

(21) Appl. No.: 10/867,719

(22) Filed: Jun. 16, 2004

(65) Prior Publication Data

US 2004/0238473 A1 Dec. 2, 2004

Related U.S. Application Data

(63) Continuation-in-part of application No. PCT/AU03/00668, filed on May 30, 2003.

(30) Foreign Application Priority Data

May 30, 2002 (AU) ..... PS 2660

(51) Int. Cl.
*B66C 19/00* (2006.01)

(52) U.S. Cl. ..... 212/315; 104/94; 104/111

(58) Field of Classification Search ..... 212/312, 212/315; 104/111, 94
See application file for complete search history.

(56) References Cited

U.S. PATENT DOCUMENTS

| | | | | | |
|---|---|---|---|---|---|
| 718,676 | A | * | 1/1903 | Taylor | 212/312 |
| 871,255 | A | * | 11/1907 | Bragg | 212/312 |
| 1,443,382 | A | * | 1/1923 | Rapier | 104/98 |
| 1,752,026 | A | * | 3/1930 | Phillips | 105/163.1 |
| 2,416,352 | A | * | 2/1947 | Seward | 104/107 |
| 2,725,973 | A | * | 12/1955 | King | 198/683 |
| 2,825,291 | A | * | 3/1958 | Chadenson | 104/94 |
| 2,845,877 | A | * | 8/1958 | Richter | 104/98 |
| 2,884,871 | A | * | 5/1959 | Mazzola et al. | 105/148 |
| 2,905,806 | A | * | 9/1959 | Tunney | 362/459 |
| 3,095,174 | A | * | 6/1963 | Dehn et al. | 248/324 |
| 3,842,785 | A | | 10/1974 | Rivet | |
| 3,974,777 | A | * | 8/1976 | Monne | 104/94 |
| 4,116,134 | A | * | 9/1978 | Troth | 104/111 |
| 4,289,076 | A | * | 9/1981 | Miller | 105/163.1 |
| 5,080,021 | A | | 1/1992 | Thorsen | 105/163 |
| 5,360,123 | A | * | 11/1994 | Johnston | 212/324 |
| 5,487,478 | A | * | 1/1996 | Morrow | 212/253 |
| 5,660,143 | A | * | 8/1997 | Waring-Brown | 119/400 |
| 5,669,518 | A | * | 9/1997 | Kundel | 212/315 |
| 5,799,581 | A | * | 9/1998 | Taylor | 104/111 |
| 6,010,019 | A | * | 1/2000 | Johnston | 212/324 |
| 6,058,849 | A | * | 5/2000 | Ostholt et al. | 104/93 |
| 6,196,133 | B1 | * | 3/2001 | Fitzler et al. | 105/148 |

FOREIGN PATENT DOCUMENTS

| | | | |
|---|---|---|---|
| CA | 2222826 | A1 | 5/1998 |
| CN | 20547786 | U | 3/1990 |
| DE | 1279902 | B | 10/1968 |
| EP | 0960848 | A2 | 12/1999 |
| GB | 199290 | A | 6/1923 |

(Continued)

*Primary Examiner*—Thomas J. Brahan
(74) *Attorney, Agent, or Firm*—David A. Guerra

(57) ABSTRACT

A lifting assembly comprising parallel guides (18, 20), a carriage (26, 28) associated with each parallel guide (18, 20) and movable along the length of the parallel guides, a displacement arm (40) pivotally connected to each carriage (26, 28) and pivotally supporting a bridge (14), preferably a trolley (13) located on the bridge (14) including attachment means (12) for supporting a lifting device.

20 Claims, 9 Drawing Sheets

FOREIGN PATENT DOCUMENTS

| | | | | |
|---|---|---|---|---|
| JP | 54-64350 | A | * | 5/1979 |
| JP | 04-045096 | | | 2/1992 |
| JP | 7-12382 | | | 2/1995 |
| JP | 07-076489 | | | 3/1995 |
| JP | 2000016751 | A | | 1/2000 |
| RU | 2167100 | C1 | | 5/2001 |
| SU | 141276 | | | 2/1960 |
| SU | 420541 | A1 | | 3/1974 |
| SU | 1147672 | A | | 3/1985 |
| SU | 1440853 | A1 | | 11/1988 |
| SU | 1440853 | A1 | | 11/1988 |

* cited by examiner

Fig 10
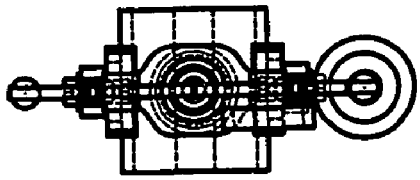
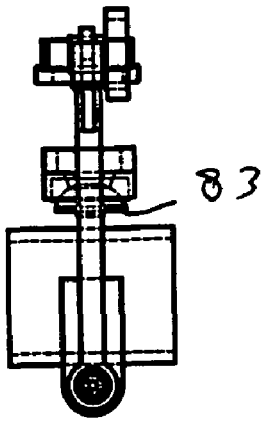
Fig 8
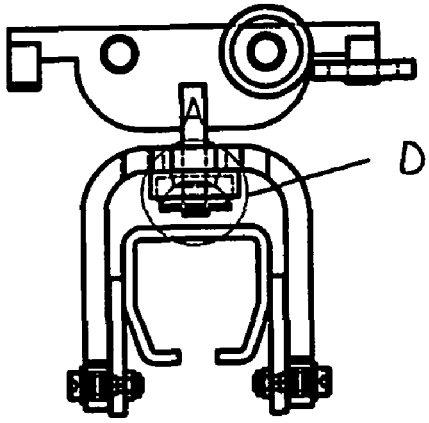
Fig 9
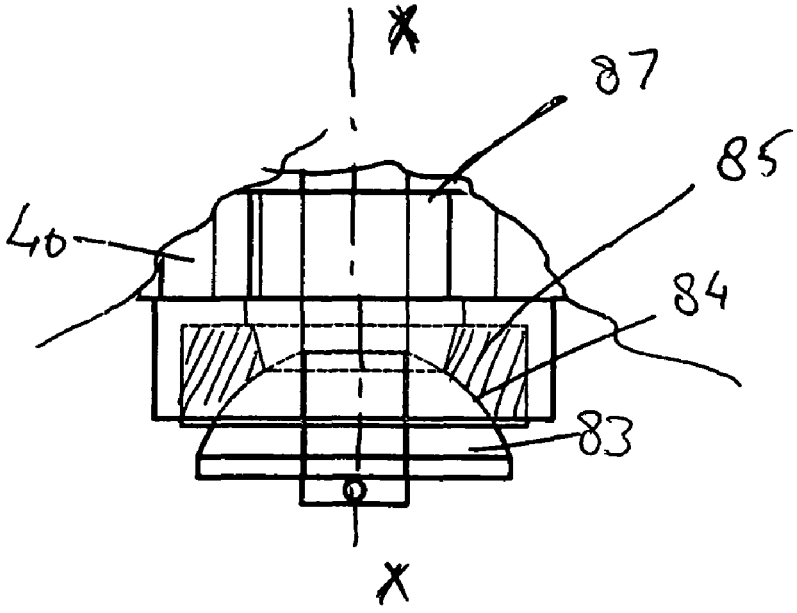
Fig 11

CRANE ASSEMBLY

This is a continuation in part of PCT/AU03/00668 filed May 30, 2003 and published in English.

FIELD OF THE INVENTION

The present invention relates generally to an improved crane assembly. The invention has particular application to a manually operated suspended (or overhead) crane assembly, which is configured to provide easier operation for the assembly operator. The invention will therefore be described in this context. However, it will be appreciated that the invention has broader application and is not limited to that particular use.

BACKGROUND OF THE INVENTION

Manually operated suspended crane assemblies such as a gantry crane or bridge crane are used in a great variety of industrial and other applications for lifting and moving objects. Suspended crane assemblies can be designed to lift and move any practical weight.

Existing suspended crane assemblies generally include a crane, which is suspended from a trolley that is, in turn, suspended from at least one bridge. The trolley is capable of longitudinal movement along the at least one bridge. The at least one bridge is movably supported (generally in a suspended manner) at either end from a pair of parallel tracks or guides. The tracks or guides are generally mounted to a building ceiling or roof structure. Alternatively, the tracks or guides (hereinafter referred to simply as "guides") could be supported from a steel superstructure. This is a particularly attractive option in situations where the building ceiling or roof structure concerned is not designed to bear loads.

One problem with existing assemblies occurs when an operator attempts to initiate movement of the bridge in either direction relative to the guides. The effort required to initiate such movement is often considerable, at least in part owing to the fact that movement of the other end of the bridge is initiated. This can cause the bridge to twist relative to the stationary guides, and thereby jam and prevent further movement.

Another problem with existing assemblies is the fact that the guides must be aligned parallel or very close to parallel during installation. If not, the bridge tends to jam in the guides preventing further movement.

OBJECT OF THE INVENTION

It is an object of the invention to overcome or alleviate one or more of the above problems of lifting assemblies or to provide the consumer with a useful commercial choice.

SUMMARY OF THE INVENTION

According to one aspect, the present invention provides a lifting assembly comprising:

a pair of parallel guides;

a carriage associated with each parallel guide and movable along the length of said guide;

a connection means pivotally connecting each said carriage to one end of a bridge; and an attachment means associated with the bridge;

wherein said connection means includes a universal connection to absorb rotational and lateral motions of the bridge when a force is applied to the attachment means.

The attachment means is suitably connected to a trolley located on the bridge and that is movable along the bridge.

The lifting device could be rigidly connected to the bridge. However, more preferably, the lifting device is movable along the bridge on the trolley. This desirably enables greater manoeuvrability of the lifting device. The lifting device could be movable by any suitable means. Most preferably, the lifting device is manually movable relative to the bridge. However, the lifting device could instead be movable, for example, electrically relative to the bridge.

In a preferred form, the lifting device is a crane. The crane could be raised and lowered to lift an object by any suitable means. In particularly envisaged forms, a manually and/or electrically operable crane could be adopted to raise and lower an object.

It is to be appreciated that the assembly does not include the lifting device, or part thereof. The inclusion of the lifting device in the discussion of the present invention is merely provided to define the context of the invention.

Most preferably, each bridge is longitudinally displaceable relative to the carriages. This further prevents the carriages from jamming on/in the guides. In one preferred form, the longitudinal displacement is provided by way of a displacement arm, which is pivotally connected at either end, respectively, to the bridge and the carriages. However, longitudinal displacement could occur via any other suitable arrangement.

The pivotal connection of the carriages to the bridge could adopt any suitable form. The pivotal connection acts as a universal joint with the displacement arm. The pivotal connection enables the carriages to commence movement along one guide prior to the carriages commencing movement along the other guide(s). This pivotal connection effectively absorbs lateral and axial movement of the bridge and translates applied force into longitudinal movement of the bridge along the guides. This has been found to reduce the exertion necessary to initiate movement of the carriages. It has also been found to reduce the incidence of the carriages becoming jammed on/in the guides. The displacement arm is also pivotally connected to a bridge sleeve which is rigidly fixed to the bridge.

Preferably, the bridge includes an at least one substantially horizontally extending beam or girder. The beam or girder could be any suitable profile, including an I-beam or a thin walled open section such as a C-section. A single bridge could be used to support the lifting device. However, the use of two or more bridges could also be adopted, thereby enabling the bridges to be longer, for comparable loads, and so may be preferred in some applications. The use of two or more bridges also enables larger loads to be lifted, and enables a lower overall lifting device height to be achieved.

In one particularly preferred form, the carriages include guide rollers, which are provided to enable longitudinal movement of the carriages along the guide. However, it is to be appreciated that the carriage could adopt and/or include any other suitable form.

The carriages could be moved relative to the guides by any practical means. While, it is particularly preferred that the carriages be manually movable relative to the guides, it is to be appreciated that the carriages could be moved relative to the guides by, for example, electrical means.

Any practical number of guides could be incorporated into the crane assembly. Most preferably, however, two guides are provided, with the bridge spanning across the two guides.

The guides could adopt any suitable length and any suitable profile or cross-section. Possible guide designs include hollow C-sections (thin walled open channel sections) with inside-running surfaces, and I-beam sections with outside-running surfaces.

Furthermore, the guides could be supported at any suitable height by any suitable means. In one form, the guides could be supported from a building roof and/or ceiling, or from a specially erected superstructure.

It will be convenient to hereinafter describe an embodiment of the invention in greater detail with reference to the accompanying drawings. The particularity of these drawings in the related description is to be understood as not superseding the generality of the preceding broad, description of the invention.

BRIEF DESCRIPTION OF THE DRAWINGS

Embodiments of the invention will now be described with reference to the accompanying drawings in which:

FIG. 8 is a view from direction A of FIG. 7;

FIG. 9 is a view from direction B of FIG. 7;

FIG. 10 is a view from direction C of FIG. 7;

FIG. 11 is a close up of region D of FIG. 9;

DETAILED DESCRIPTION OF THE PREFERRED EMBODIMENTS

Figure 1:
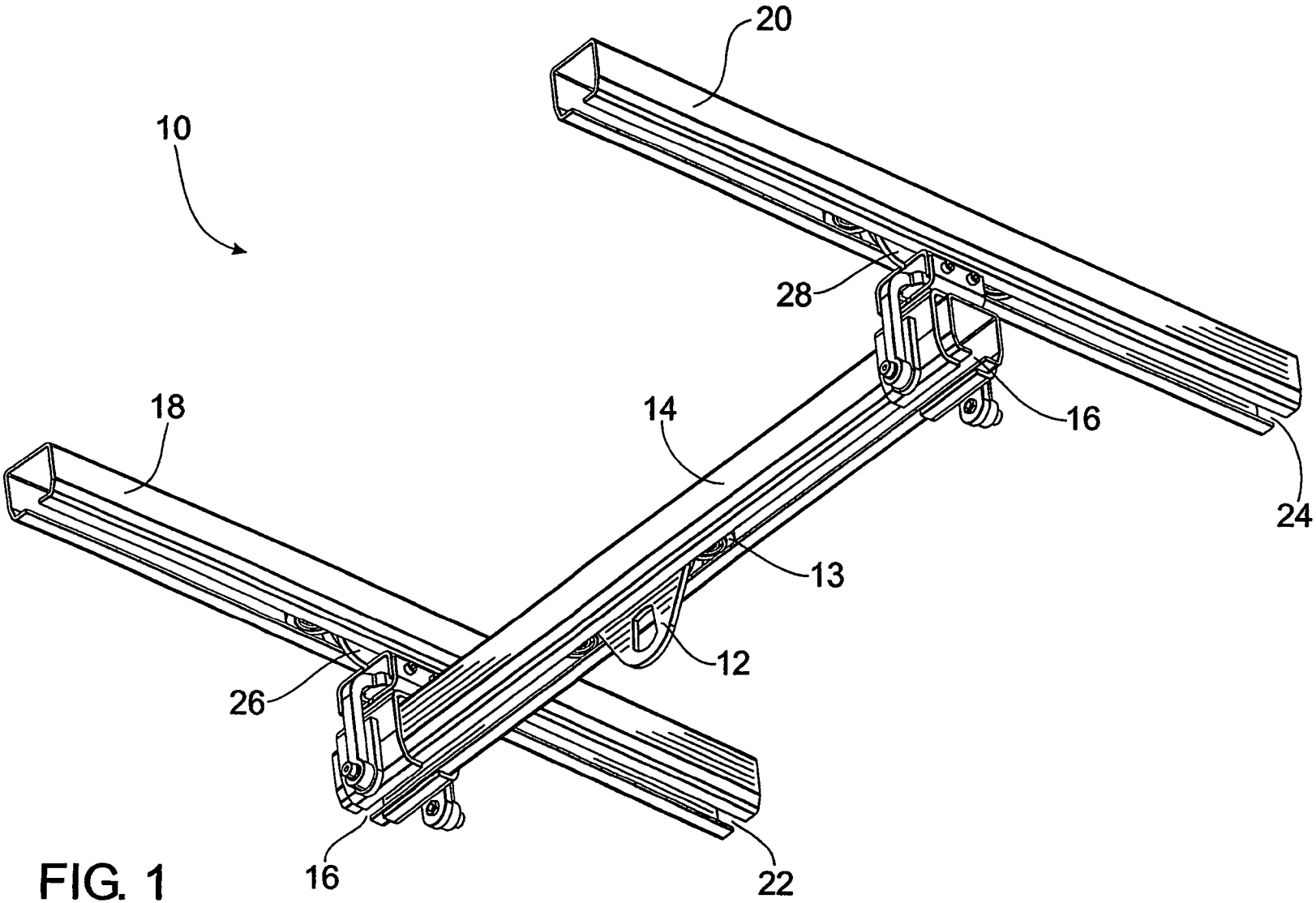
FIG. 1 is a perspective view of an overhead lifting assembly according to an embodiment of this invention.

FIG. 1 illustrates a lifting assembly 10. A lifting device in the form of a manually operated crane (not illustrated) may be suspended from the lifting assembly by attachment means 12. The attachment means 12 could be a hook, chain or other suitable device. It is to be appreciated, that the lifting device could adopt any suitable form. For example, the lifting device could be a manually or an electrically operated crane.

The attachment means 12 is connected to a trolley 13. The trolley 13 is movably suspended from a bridge 14. The bridge 14 could be in the form of an open channel section, an I-beam, or any other suitable form. The trolley 13 includes trolley rollers being wheels, ball bearings or other suitable propulsion means. The rollers are capable of rolling longitudinally along the bridge 14. The trolley rollers could adopt any suitable form. In this respect, the trolley rollers could include plastic coated rolling surfaces for silent running. Alternatively, the rollers, including the roller surfaces, could be constructed from steel. Alternatively other mechanisms could be used in place of rollers, such that the trolley 13 is movable along the length of the bridge 14.

The attachment means 12 extends through an opening 16 provided in the underside of the bridge 14. In this way the attachment means 12 (and crane) is movable along the length of bridge 14. Where the bridge does not have a slot, the attachment means 12 is connected to the trolley 13 or bridge 14.

It is to be appreciated that the attachment means 12 could be movably connected to two or more bridges 14.

Two substantially parallel guides 18, 20 are provided. The bridge 14 is movable longitudinally relative to the parallel guides 18, 20. In the illustrated embodiment of the invention, the bridge 14 is manually movable relative to the parallel guides 18, 20. Again, however, it is to be appreciated that the bridge 14 could be electrically movable relative to the parallel guides 18, 20.

The parallel guides 18, 20 as shown formed from an open channel C-section are respectively provided with openings 22, 24.

In the illustrated embodiment the parallel guides 18, 20 are rigidly secured to a building ceiling, roof or separate superstructure 19. However, it is to be appreciated that the parallel guides 18, 20 could be provided with some movement relative to their mountings, if desired.

Figure 3:
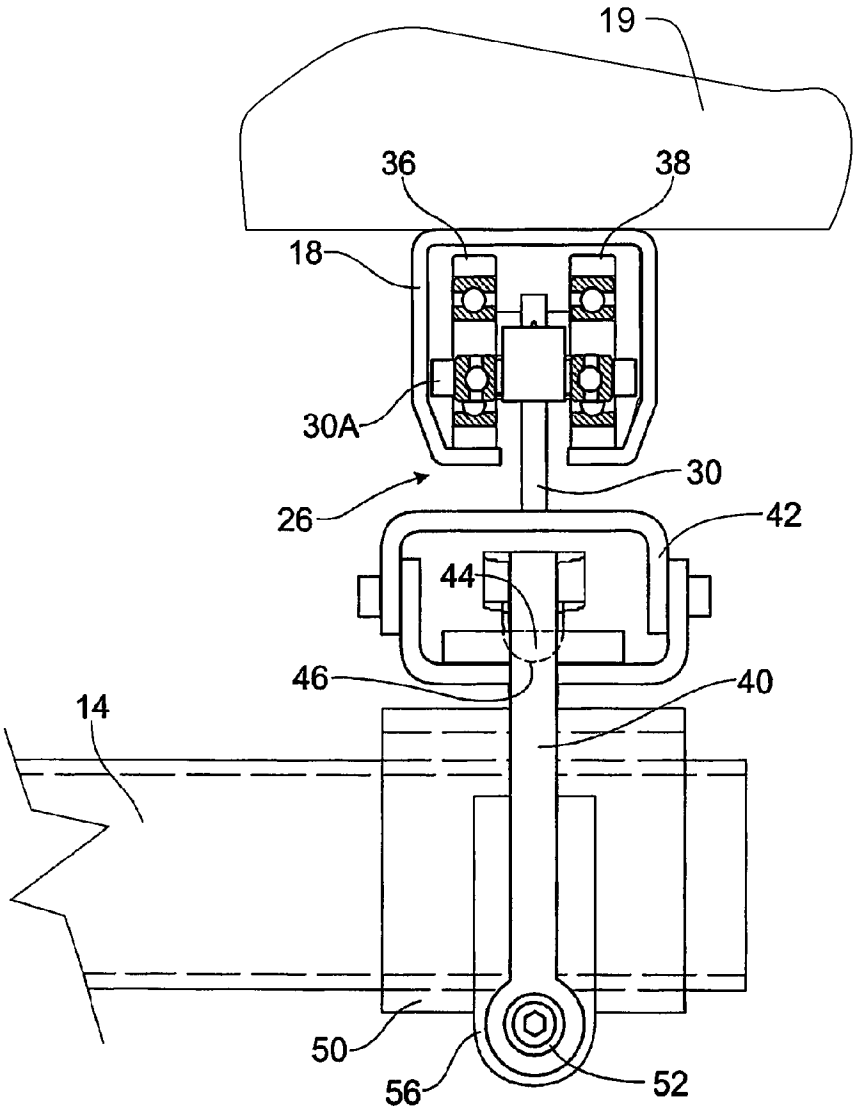
FIG. 3 is a partial cross-sectional view of the carriage illustrated in FIG. 2.

The bridge 14 includes carriage 26, 28. The carriages 26, 28 are provided for travelling along the parallel guides 18, 20 respectively. The relationship and configuration of the carriage 26 and the guide 18 is substantially identical to that of the carriage 28 and the guide 20. Therefore, the following description, with reference to FIGS. 3 and 4, in part, refers only to the carriage 26 and the guide 18.

Figure 4:
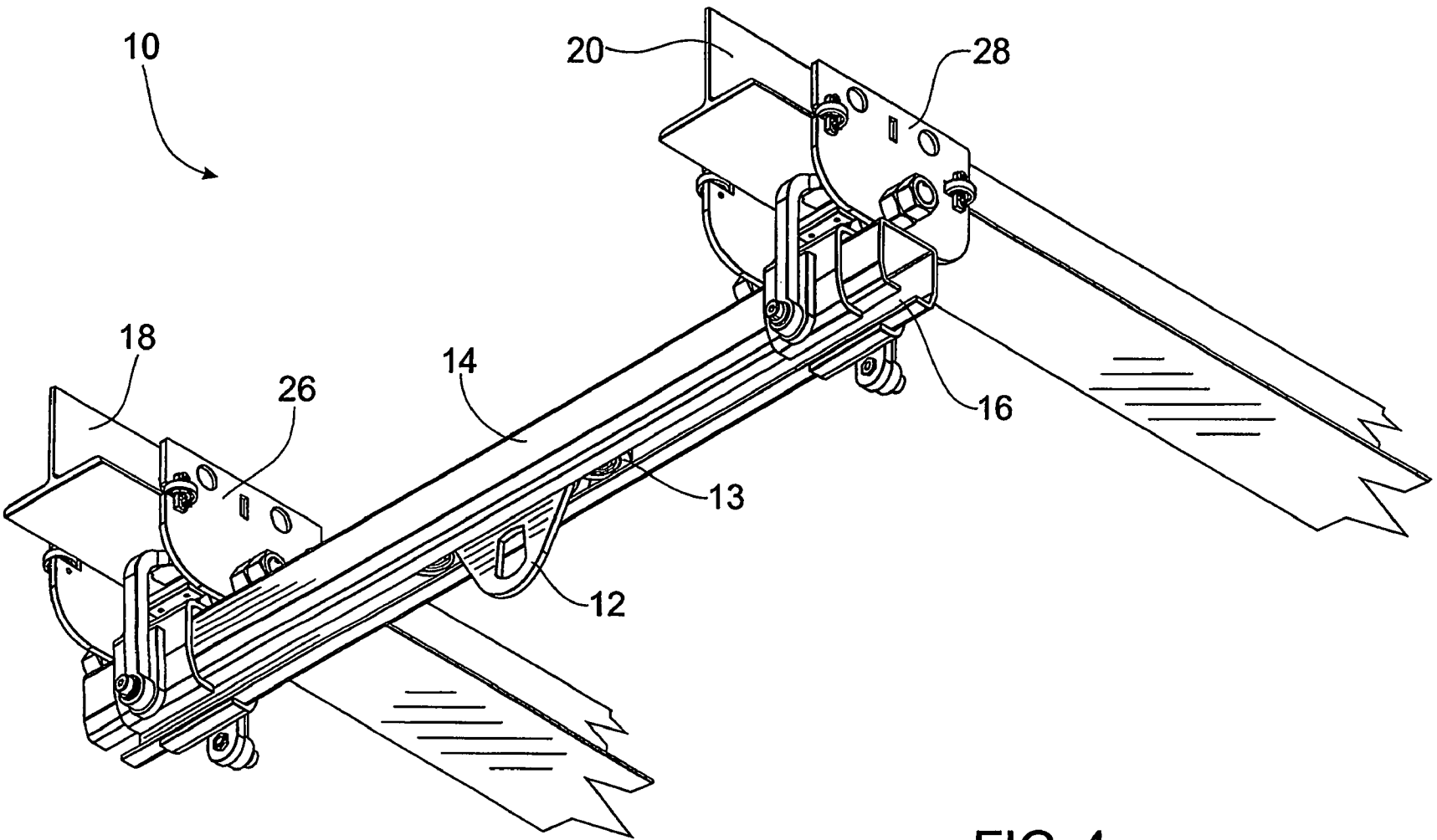
FIG. 4 is perspective view of an overhead lifting assembly according to another embodiment of this invention.
Figure 6:
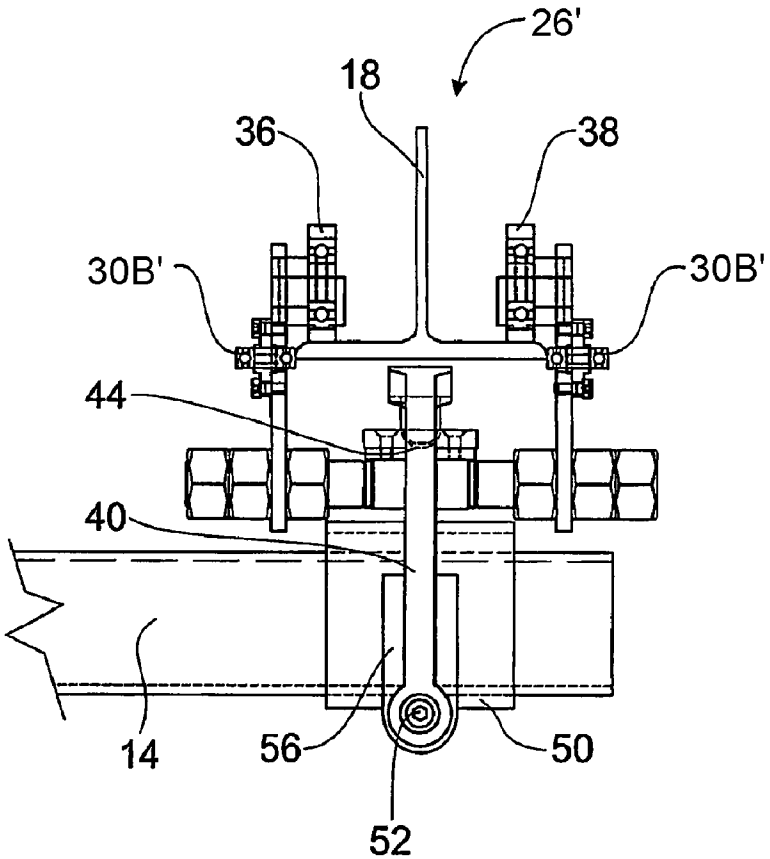
FIG. 6 a partial cross-sectional view of the carriage illustrated in FIG. 5.
Figure 5:
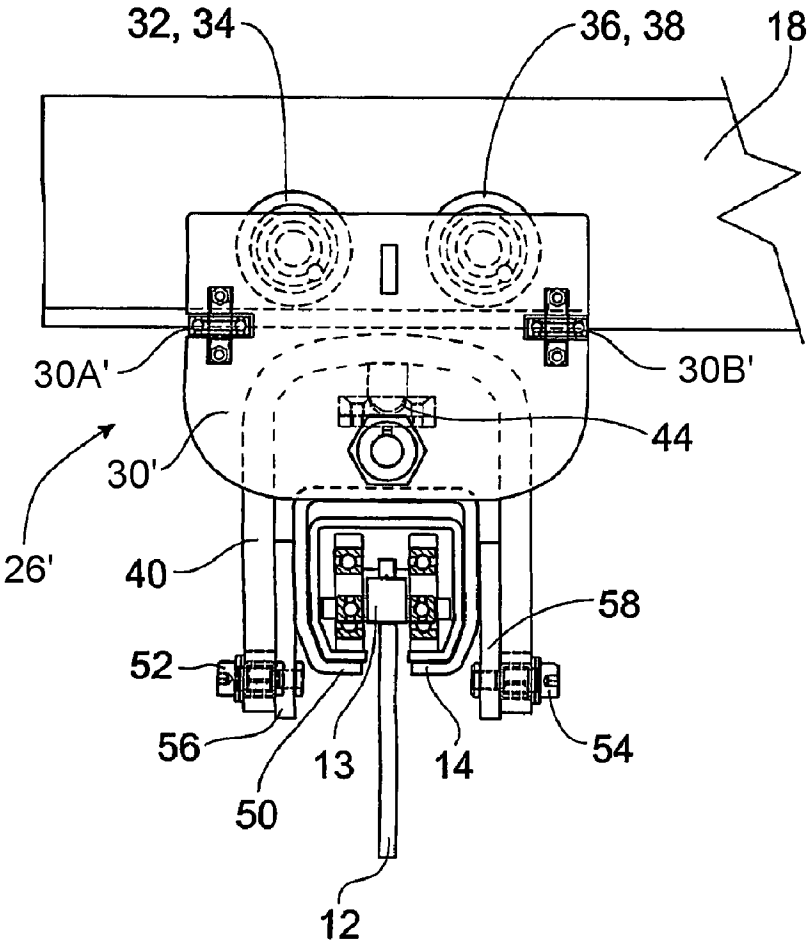
FIG. 5 is a front view of a carriage illustrated in FIG. 4.

The parallel guides 18, 20 are illustrated in FIG. 1 as being open channels in profile, and therefore include an internal track system. It is to be appreciated, however, that the guides 18, 20 could adopt other suitable profiles, including I-beam (or external track) profiles, as shown in FIGS. 4, 5 and 6.

The carriage 26, or similar device, is movable along the parallel guides 18, 20, and includes at least one mounting plate 30, 30'. The mounting plate 30, 30' is configured to travel longitudinally along the parallel guide 18 by way of rollers 32, 34, 36, 38, which are rotatably mounted to the mounting plate 30, 30'. The carriages 26, 28 bear the weight of the bridge 14 and the crane (not illustrated), which is, in turn, borne by the parallel guides 18, 20. An additional mounting plate 30, 30' may be used external of the profile (I-beam).

Preferably, the rollers 32, 34, 36, 38 include tapered surfaces thereby enabling the rollers 32, 34, 36, 38 to roll efficiently along the guides 18, 20. The rollers 32, 34, 36, 38 include plastic (or rubber) coated rolling surfaces. The plastic coated rolling surfaces are provided to reduce rolling noise of the rollers 32, 34, 36, 38. It is to be appreciated, however, that the rollers 32, 34, 36, 38 need not include plastic coated rolling surfaces. The rollers 32, 34, 36, 38 could instead include, for example, steel rolling surfaces.

Furthermore, it is to be appreciated that the rollers 32, 34, 36, 38 could be replaced by another suitable arrangement such as, for example, a bearing arrangement.

Existing crane assemblies tend to jam when an operator initiates movement of the bridge (comparable to the bridge 14) along the assembly guides (similar to guides 18, 20). This is, in part, a result of the rigid connection in existing crane assemblies of the bridge to the carriage.

To address this problem, the present invention includes a displacement arm 40. The displacement arm 40 is constructed from mild steel, or higher-grade steel, generally from steel plate or steel strip. Alternatively, the displacement arm 40 could be constructed from any other suitable material. The displacement arm 40 is pivotally connected to a sleeve 42.

The sleeve 42 is rigidly fastened (by any suitable means) to the mounting plate 30. The figures show the mounting plate 30 welded to the sleeve 42, but other means of rigid attachment such as bolting could be used. The pivotal connection between the displacement arm 40 and the sleeve 42 is by way of a ball bearing 44. The ball bearing 44 is retained in place by a ball bearing seat 46 provided in the displacement arm 40 and the sleeve 42, respectively. The ball bearing 44 could be manufactured from any suitable grade of steel, or any other suitable material. The bearing seat is formed from a plastic, such as nylon, to minimise friction, but could be formed from other suitable materials.

Figure 2:
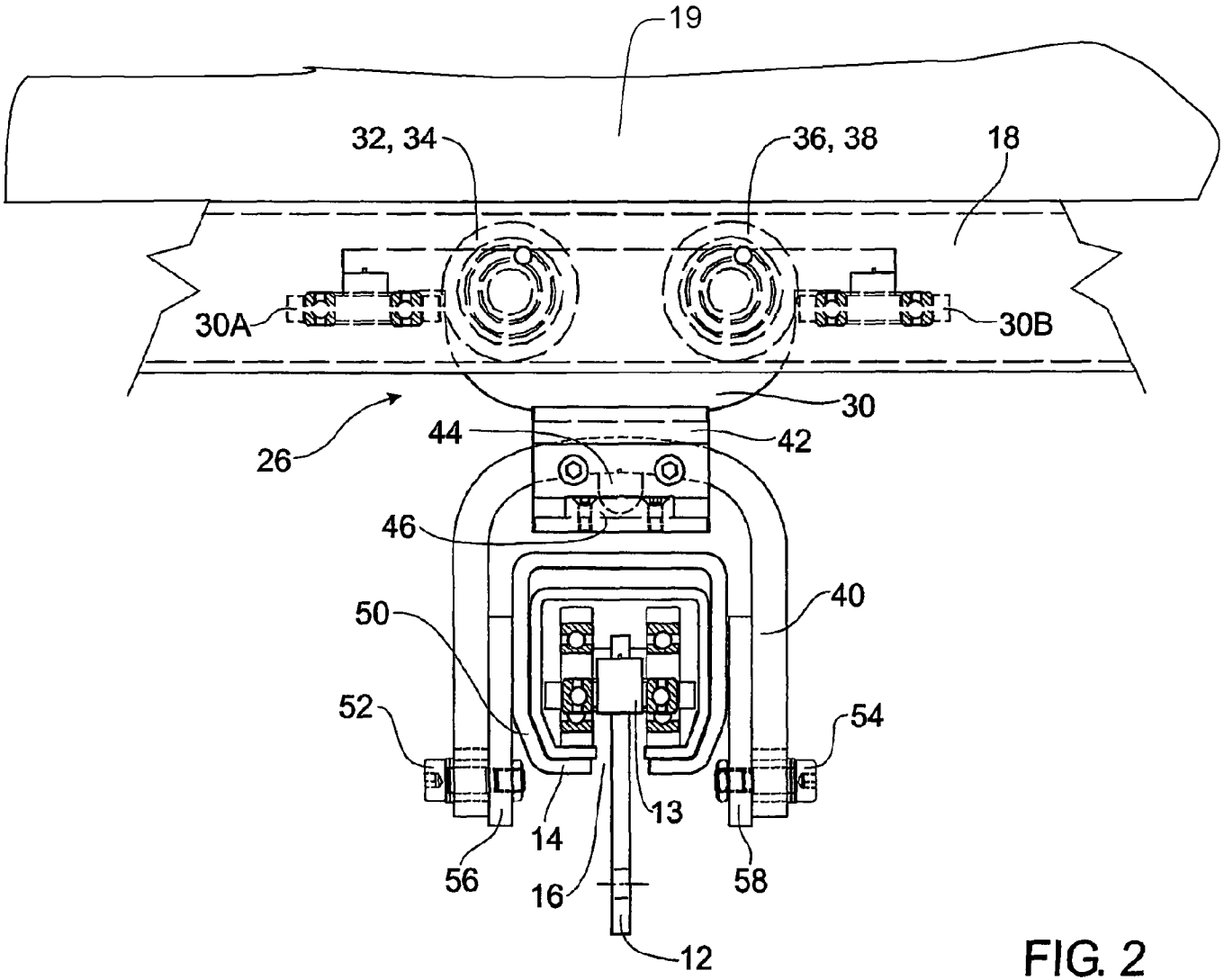
FIG. 2 is a front view of a carriage illustrated in FIG. 1.

The displacement arm 40 is pivotally connected to a bridge sleeve 50 (see FIGS. 2 and 3) which, in turn, is securely connected to one end of the bridge 14. The bridge sleeve 50 is constructed from steel. Any suitable grade steel (or any other material) could be used in the construction of the bridge sleeve 50. The displacement arm 40 is pivotally connected to the bridge sleeve 50 by two fasteners 52, 54 via displacement arm appendages 56, 58. The fasteners 52, 54 provide a pivotal connection between the displacement arm 40 and the bridge sleeve 50.

The above arrangement forms a universal joint that provides the necessary relative pivoting and lateral movement between the carriage 26, 28 and the bridge 14 to at least reduce the incidence of jamming of the lifting assembly 10, upon initiating movement of the bridge 14 relative to the parallel guides 18, 20.

It is to be appreciated that the pivotal connection of the carriages 26, 28 to the bridge 14 could adopt a configuration (s) different to that specifically described above. The pivotal connection could, instead, include a rod end, or other pivotal/rotatable linkage arrangement.

The mounting plate 30, 30' includes a safety mechanism in the form of anti-derailment means 30A, 30B, 30A', 30B' respectively. The anti-derailment means 30A, 30B, 30A', 30B' are ball bearings or similar, which ensure the carriages 26, 28, 26', 28' remain engaged with the guide 18. The anti-derailment means 30A, 30B, 30A', 30B' are provided to prevent the bridge 14 and crane crashing to the ground in the event of failure of the rollers 32, 34, 36, 38 or other parts of the carriage 26, 28, 26', 28'.

The bridge 14 and the parallel guides 18, 20 are formed from cold-rolled steel in tube or bar.

It is to be appreciated that part(s) of the above-described arrangement could be incorporated into existing assemblies. In this respect, Applicant envisages that the arrangements illustrated in FIGS. 2, 3, 5 and 6 in their entirety or in part, could be incorporated into existing assemblies.

In FIG. 4, the lifting assembly 10 is shown for parallel guides 18, 20 in the form of an I-beam rather than an open channel C-section. In this form the carriages 26', 28' capture the beam flanges between the wheels 32, 34, 36 and 38, as illustrated.

FIGS. 5 and 6 show the carriages 26' adapted to fit an I-beam parallel guide 16. Similarly, the trolley 13 can be fitted to an I-beam bridge (not shown).

The illustrated lifting assembly 10 has been designed to lift objects of up to half a tonne in weight. However, the reader is to appreciate that the lifting assembly 10 of the present invention could be designed to lift any practical weight, including weights well in excess of half a tonne.

The present invention has been found to at least reduce the incidence of jamming experienced by existing assemblies.

The present invention has been found to at least accommodate situations in which the parallel guides 18, 20 are not mounted exactly parallel to one another.

The present invention has also been found to require less operator effort to initiate movement of the bridge 14 along the parallel guides 18, 20 when compared to existing assemblies.

Moreover, the present invention is particularly useful, because it can be relatively easily incorporated into existing assemblies.

Figure 12:
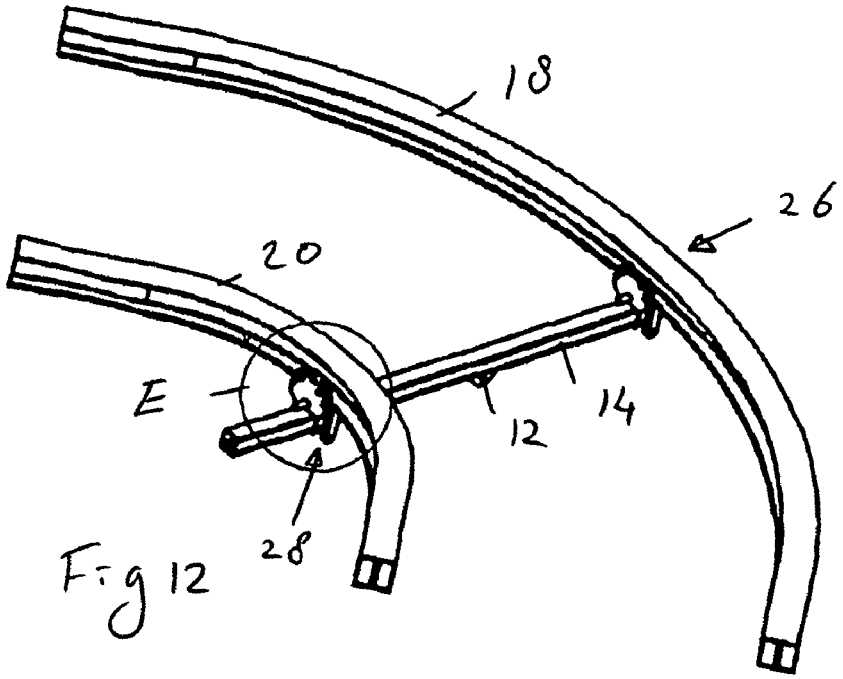
FIG. 12 is a perspective view of part of the guides wherein such are in a curved or non-linear but preferably still parallel condition.
Figure 13:
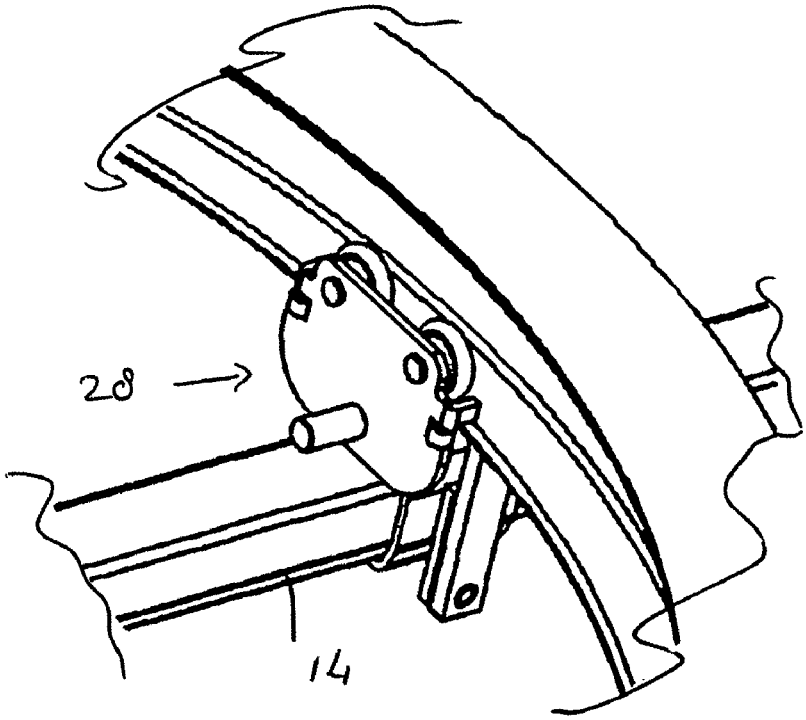
FIG. 13 is a close up view of region E of FIG. 12.
Figure 14:
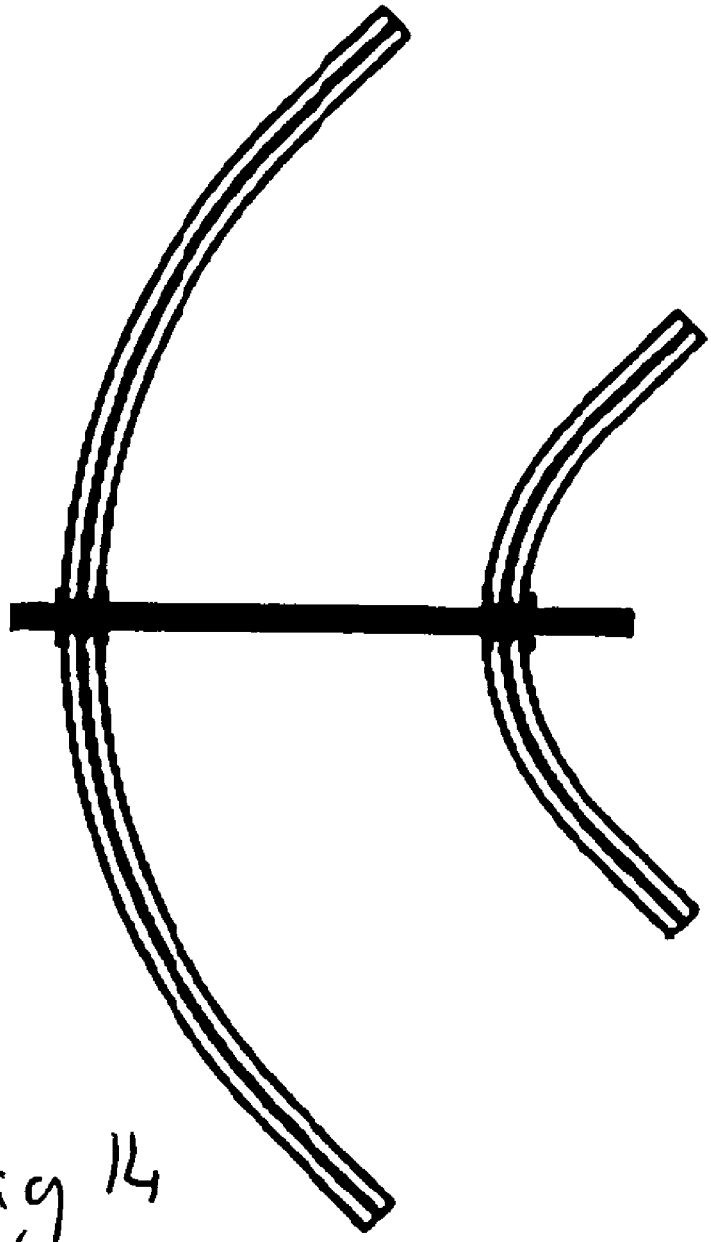
FIG. 14 is a plan view of FIG. 12.
Figure 15:
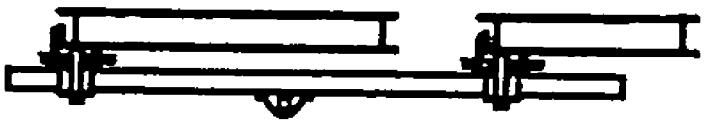
FIG. 15 is a side view of FIG. 12.

With reference to FIGS. 12 and 13 there are shown guides 18, 20 which are in a curved or nonlinear configuration. The present invention conveniently lends itself to allowing for the movement of a bridge 14 guided by guides 18, 20 around a curved or nonlinear locus. Any nonalignment issues are accommodated because of the degree of freedom incorporated. Whilst in the most preferred form the guides 18, 20 will remain parallel throughout any linear or nonlinear transition of support to the bridge 14, such need not necessarily always occur. In travelling about a curved guide, the bridge 14 may not always remain perpendicular to the tangent of both guides 18, 20. As such the degrees of freedom provided by the carriages 26, 28 allow for convenient movement of the bridge 14 around such transition regions. It may well be that the entire guide is of a nonlinear configuration or that only part of the guide is nonlinear, other parts being substantially rectilinear.

Figure 7:
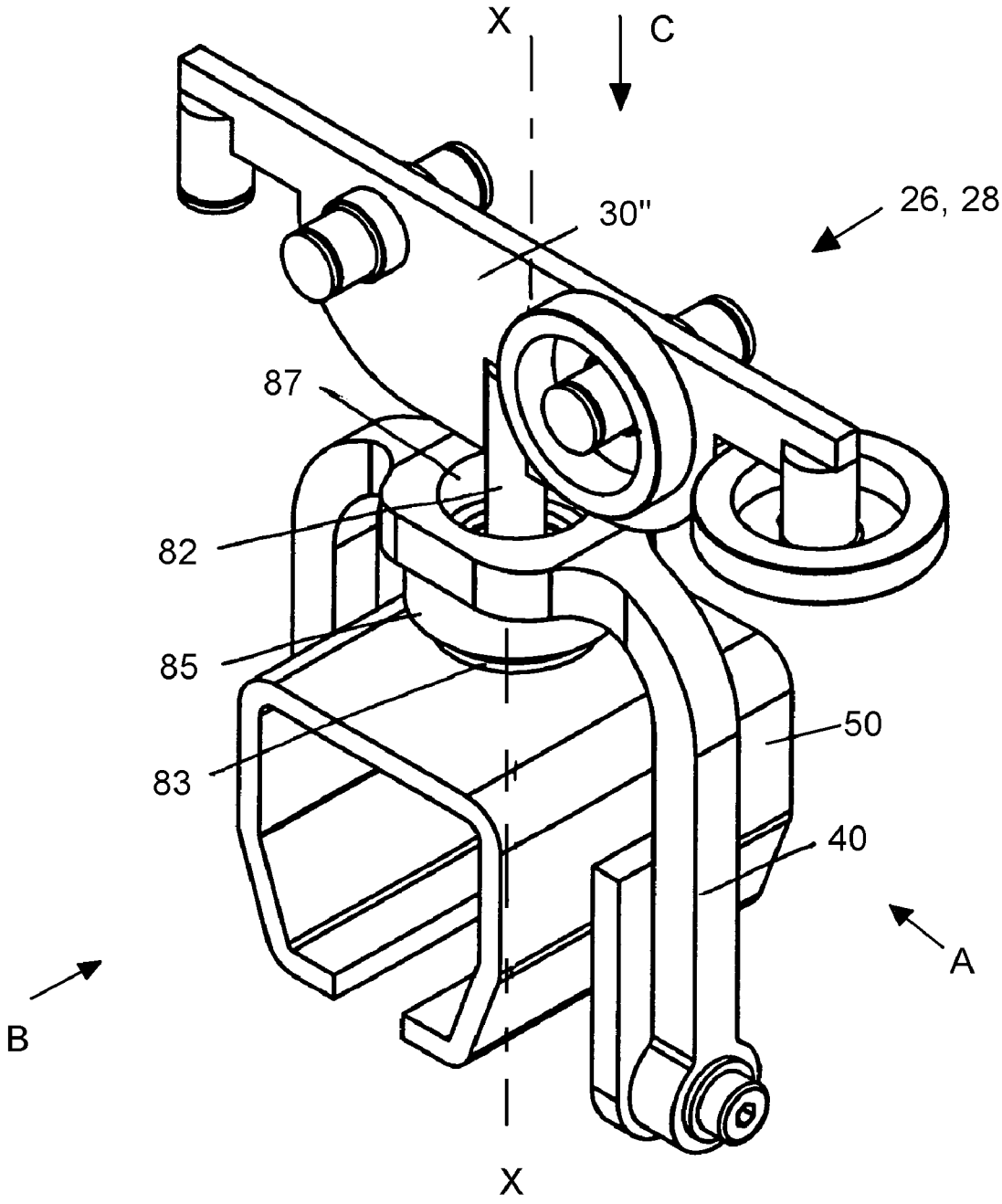
FIG. 7 is a perspective view of a slightly differently configured carriage 26, 28 wherein the suspension coupling formed by the ball bearing and ball bearing seat have been replaced by a suspension arm including a semi-spherical suspension lug supported in a seat.

To enhance the degree of freedom of movement and also provide for a simpler and hence cheaper construction of the carriages 26, 28, reference will now be made to the carriage 26, 28 as shown in FIG. 7. These include a mounting plate 30" from which there is disposed a support arm 82. The support arm 82 is preferably an axle or shaft or rod or the like which defines a pivot axis XX. The pivot axis by the presentation of the arm 82 in an appropriate direction extending from the mounting plate 30" will in use provide the axis XX substantially vertically. Rather than providing significant degree of freedom about the two orthogonal horizontal axes as provided by the carriage of FIG. 2 for example, the carriage of FIG. 7 also allows for the full 360 degree rotation (if needed) of the bridge sleeve 50 about a vertical axis. The arm 82 suspends at a distance away from the mounting plate 30", a support lug 83 as for example shown in FIGS. 8 and 11. The support lug 83 presents a partially spherical or semi-spherical bearing surface 84 in an upward direction so that a seat 85 can bear downwards on the surface 84. The seat 85 is associated with the displacement arm 40 to upwardly support the displacement arm 40 and hence the bridge sleeve 50. The arm 82 extends through an aperture 87 sufficiently large through the displacement arm 40. The seat can move over the surface 84 of the lug 83 to both rotate about the X axis or to pivot to a certain extent to the two orthogonal horizontal axes.

Finally, it is to be understood that various alterations, modifications and/or additions may be introduced into the construction and arrangement of the parts previously described without departing from the spirit or ambit of the invention. For instance, the lifting assembly could incorporate multiple parallel guides and multiple bridges.

The invention claimed is:

1. A lifting assembly comprising:

a pair of overhead guides positioned parallel to one another;

a carriage associated with each overhead guide and movable along and within the length of the said guide, each carriage having at least one mounting plate configured to travel longitudinally along its respective parallel guide by way of at least one roller rotatably mounted to the mounting plate;

first sleeves rigidly fastened to each of the mounting plates;

a bridge attachable to the carriages, the bridge being movable longitudinally relative to the parallel guides;

a bridge sleeve fixedly connected to each end of the bridge;

an attachment means associated with the bridge for supporting a lifting device, the attachment means being moveable along the length of the bridge; and a displacement arm pivotally connected to each of an interior of said first sleeves by way of a ball bearing and pivotally connected to each of the bridge sleeves by a fastener received through a displacement arm appendage positionable between the displacement arm and the bridge sleeve and extending down from ends of the displacement arm, said first sleeves being rigidly fastened to each of the mounting plates of the carriage; and a trolley located on the bridge and movable along the bridge, and wherein the attachment means is connected to the trolley.

2. The lifting assembly of claim 1 wherein the ball bearing is located on a seat fixed to the carriage.

3. The lifting assembly of claim 2 wherein the seat is formed from a plastic.

4. The lifting assembly of claim 3 wherein the seat is formed from nylon.

5. The lifting assembly of claim 1 wherein the displacement arm is formed from steel.

6. The lifting assembly of claim 5 wherein the displacement arm is connected to the bridge sleeve by a linkage pin through each of said displacement arm appendages.

7. The lifting assembly of claim 1 wherein the carriage includes a guide means.

8. The lifting assembly of claim 7 wherein the guide means is a ball bearing.

9. The lifting assembly of claim 1 wherein the bridge is a beam.

10. The lifting assembly of claim 9 wherein the beam is a hollow C-section.

11. The lifting assembly of claim 1 wherein the guides are fixed to a ceiling.

12. The lifting assembly of claim 1 wherein the guides are suspended from a superstructure at a required height.

13. The lifting assembly of claim 1 wherein the carriage includes an anti-derailment means.

14. The lifting assembly of claim 13 wherein the anti-derailment means is ball bearings.

15. The lifting assembly of claim 1 wherein the rollers of the mounting plates of the carriages are wheels.

16. The lifting assembly of claim 1 wherein the rollers of the mounting plates of the carriages are ball bearings.

17. A lifting assembly comprising:

a pair of guides positioned parallel to one another and attachable to an overhead superstructure;

a carriage associated with each parallel guide and movable along and within the length of the said guide, each carriage having at least one mounting plate configured to travel longitudinally along its respective parallel guide by way of at least one roller rotatably mounted to the mounting plate;

first sleeves rigidly fastened to each of the mounting plates;

a bridge attachable to the carriages, the bridge being movable longitudinally relative to the parallel guides;

a bridge sleeve fixedly connected to each end of the bridge;

an attachment means associated with the bridge for supporting a lifting device, the attachment means being moveable along the length of the bridge; and a displacement arm pivotally connected to each of an interior of said first sleeves by way of a ball bearing and pivotally connected to each of the bridge sleeves by a fastener received through a displacement arm appendage positionable between the displacement arm and the bridge sleeve and extending down from ends of the displacement arm, said first sleeves being rigidly fastened to each of the mounting plates of the carriages.

18. The lifting assembly of claim 17, wherein the mounting plate of the carriage further comprises an anti-derailment means including at least two ball bearings adapted to ensure the carriage remains engaged with its respective guide.

19. The lifting assembly of claim 17 further comprising a trolley located on the bridge and movable along the bridge, and wherein the attachment means is connected to the trolley.

20. The lifting assembly of claim 17 wherein the ball bearing is retained in place by a ball bearing seat provided in the displacement arm and the sleeve, respectively.

* * * * *